United States Patent [19]

Greenwell

[11] 3,988,960

[45] Nov. 2, 1976

[54] METHOD AND APPARATUS FOR FAN FOLDING SHEET MATERIAL

[75] Inventor: Joseph Daniel Greenwell, Florence, Ky.

[73] Assignee: R. A. Jones & Company, Inc., Covington, Ky.

[22] Filed: Dec. 23, 1974

[21] Appl. No.: 535,440

[52] U.S. Cl. ..... 270/86

[51] Int. Cl.[2] ..... B65H 45/22

[58] Field of Search ..... 270/79, 40, 94, 86, 270/61 F; 223/28, 32–34; 93/84 R, 84 TW

[56] References Cited

UNITED STATES PATENTS

| | | | |
|---|---|---|---|
| 1,759,191 | 5/1930 | Fulk | 270/94 |
| 3,784,186 | 1/1974 | Lenthall | 270/86 |

FOREIGN PATENTS OR APPLICATIONS

| | | | |
|---|---|---|---|
| 156,812 | 12/1902 | Germany | 270/94 |
| 282,036 | 1/1931 | Italy | 270/94 |

*Primary Examiner*—Edgar S. Burr
*Assistant Examiner*—A. Heinz
*Attorney, Agent, or Firm*—Wood, Herron & Evans

[57] ABSTRACT

A method and apparatus for fan folding a web including a folding section and a guiding section upstream of the folding section. The folding and guiding sections are formed from a flat sheet of metal. The guiding section merges into the folding section on a line which is a portion of a polygon whose sides are the bases of triangles forming a plurality of sections which constitute the folding section. The guiding section is defined by portions of polygons of the same perimeter dimension as the portion of the first polygon and each of which has fewer sides than the adjacent downstream polygon.

9 Claims, 13 Drawing Figures

METHOD AND APPARATUS FOR FAN FOLDING SHEET MATERIAL

This invention relates to an apparatus for fan folding sheet material, and is particularly adapted to the fan folding of non-stretchable paper fed to the apparatus in web form.

In the past, the fan folding of a flexible web has been performed by feeding the web through a platen having spaced pie-shaped sectors which guide the web toward a nip formed, for example, between two rolls at the apices of the pie-shaped sectors. The web is guided into slots between adjoining sectors so as to form a lower crease at the nip, the upper crease being formed at the nip from the web material which tracts on the pie-shaped sectors.

For some applications, this approach may have worked reasonably satisfactorily. It has, however, a problem which the present invention overcomes, arising out of the fact that in the traverse of the web from the upstream end of the platen to the nip, all points on a transverse line across the web do not move at the same speed toward the nip. Therefore, in the traverse to the nip, some portions of the web will be more greatly stressed than other portions. This differential stressing can be accommodated if the web is stretchable to at least some extent and if the platen is long so that the angles of the apices of the sectors are very small and hence the stressing per unit length is low.

In an application where relatively unstretchable paper is required to be fan folded, and particularly where it is desired to effect the fan folding in a relatively short traverse over the platen, the platen approach as described above is not satisfactory, for the differential stressing is so abrupt that the paper will tear or become jammed in the nip or the like.

As a consequence, in the folding of leaflets, for example, which are to be packaged in cartons with other objects, a very complex leaflet folder has been employed. That leaflet folder folds the leaflets in the web in a transverse direction as the web is moving longitudinally and of necessity requires a very complex and expensive mechanism to effect the folding. Such a leaflet folder may cost many thousands of dollars.

An objective of the present invention has been to provide a folder for non-stretchable paper wherein the paper is folded in a web form as it traverses a platen formed of pie-shaped sectors. More particularly, the invention is directed to a particular geometry of the fan folding platen as well as the guide for introducing the web into the fan folding platen, the combination of the two permitting the web to be fed from a planar form into a fan folded form without differential stressing of the web across its transverse dimension.

The invention arises, in part, out of the realization that if the platen and the guide for the web into the platen can be formed from a flat sheet (or an equivalent to a flat sheet, as will be explained below) and if the web can be caused to track the contour of the flat sheet from planar form to folded form, the traverse over the guide and folding platen will not cause any differential stressing of the web.

The invention therefore contemplates a method of guiding a sheet through its folding stages from a flat web form to a fan folded form passing through a nip; the method of forming a guide for the web; and the guide structure itself.

More particularly, the invention in its preferred form is directed to the geometry of the guide and platen and includes a portion of a first polygon defining the upstream edge of the folding platen, a portion of a second polygon of half the number of sides of the portion of the first polygon with each side being twice the length of the sides of the portion of the first polygon forming a transition plane for the web as it moves toward the platen, and at least a portion of a third polygon of one-fourth the number of sides of the portion of the first polygon whose sides are four times the length of the portion of the first polygon, et seq., until arriving at the upstream edge of the guide which should be a straight edge.

These and other objectives of the invention will become more readily apparent from the following detailed description taken in conjunction with the accompanying drawings in which:

FIG. 3 is a developed view of the fan folder of FIG. 2;

Figure 1:
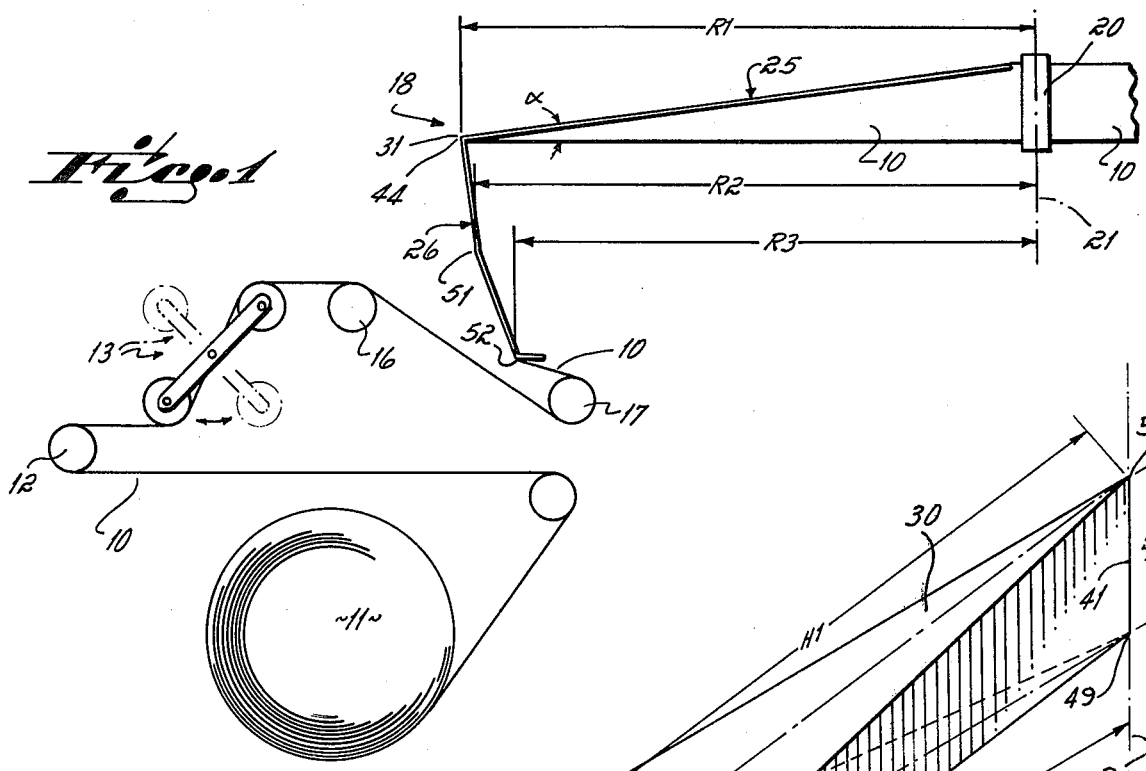
FIG. 1 is a diagrammatic side elevational view of the apparatus in accordance with the present invention.

Referring to FIG. 1, a web 10 of a flexible material is fed from a supply roll 11 over an idler roll 12, a set of pivotally mounted dancer rolls 13, an idler roll 16 and a feed roll 17 into a fan folder 18. Downstream of the fan folder is a pair of rollers 20 which between them form a nip defining a nip line 21. The rollers may be powered to draw the web through the apparatus, or other means downstream may be provided to draw the web through the apparatus including the nip.

The fan folder 18 has a folding section 25 and, upstream of the folding section, a guiding section 26. In the illustrated form of the invention the fan folder is formed from a single planar sheet which is configurated in a precise and critical manner, as will be described below, to permit the web to pass over it without any stress on the web along the transverse dimension of the web; that is to say, every point on a transverse line across the web upstream of the folder 18, while the web is in planar form, will arrive at the nip line 21 at the same time and will move toward the nip line 21 at the same speed. The avoiding of differential speed on the movement of the points on the transverse dimension avoids the differential stressing of the web and thus makes the apparatus ideally suited to the folding of non-stretchable paper. Further, since the configuration of the folder 18 eliminates stressing, it can be made quite compact.

While the folder 18 is, for the sake of manufacturing convenience, formed of a single sheet of metal, it is to be understood that it would be within the scope of the invention to design a folder from separate elements, such as rollers as long as the lines over which the sheet to be folded passes, conform to the geometry of the folder 18, as will be described.

As indicated above, the concept of the invention is perhaps most easily understood if it is viewed in the light that the configurated folder 18 was initially a planar sheet, as shown in FIG. 3, having parallel upstream and downstream edges. If the configuration of that planar sheet is such that the web passing over it will follow the contour of the sheet and that a transverse line on the paper will coincide with the upstream edge of the sheet as well as the downstream edge of the sheet, the web will occasion no differential stressing as it makes its excursion over the folder. Obviously, the web would occasion no differential stress if it passed over the flat sheet. So, too, will it occasion no differential stressing if it follows in the same path over that sheet after that sheet has been configurated into the former folder 18.

To effect the desired configuration, two major configurating steps are involved. The first is to shape the folding section 25, and the second is to shape a guiding section 26 so that the web will merge smoothly from the guiding section into the folding section.

If the web is to be folded uniformly, the folding section 25 consists of a plurality of identical triangular sections 30 whose bases 31 are interconnected at their corners. As such the bases form a portion of a first regular polygon 44. Each triangular section 30 has sides 32 which converge to an apex which is on the nip line 21 between the rollers 20. In practice, the tips of the triangle are broken away, but if extended would intersect at a point 50 on the nip line 21. In practice, too, the sides 32 are milled to the extent of about 1/32 inch so as to provide a slot through which two plies of the web pass to form a lower crease in the fan folder.

Figure 2:
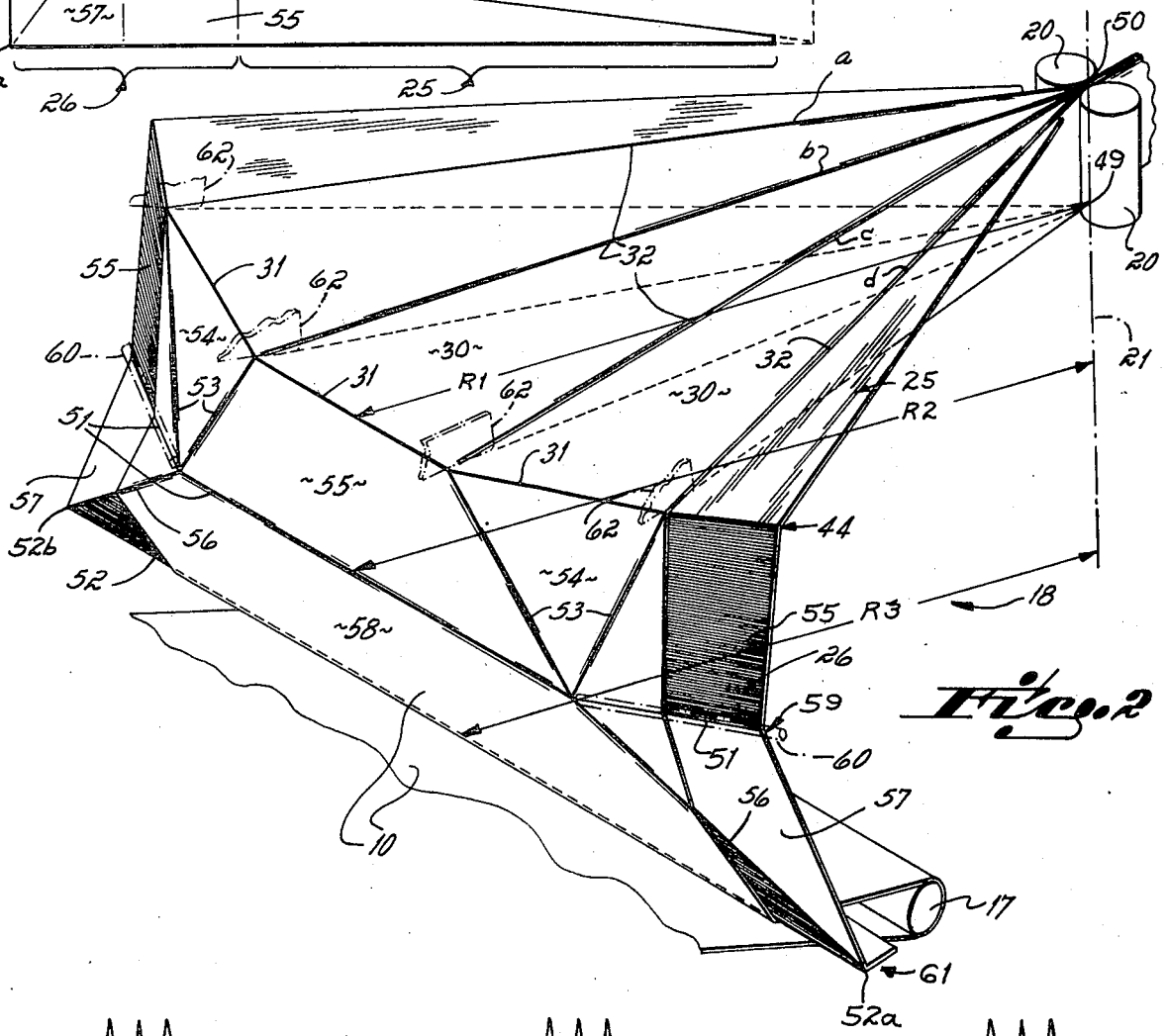
FIG. 2 is a perspective view of a fan folder, illustrating the folding of a web of paper, in accordance with the present invention.
Figure 6:
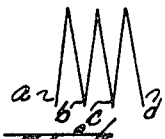
FIGS. 6, 7 and 8 are diagrammatic, cross-sectional views of fan folded webs of different configurations.

For the purpose of illustration, let it be assumed that the web 10 has a 12 inch width. It is to be fan folded into a 2 inch wide web which will therefore have six plies. The folded web as illustrated will appear as diagrammatically illustrated in FIG. 6. To attain that fan fold, the web passes over three of the triangular sections 30, each section having a 4 inch base. The triangular sections create among them four slots (a), (b), (c) and (d) (FIGS. 2 and 3). The free edges of the web pass through the slots (a) and (d) and the lower creases pass through the slots (b) and (c). The three upper creases are formed as they pass over the three triangular sections between the slots (a) and (d). The orientation of the triangular sections 30 with respect to the nip line 21 is such that the folded width of the web is one-half the length of each base 31.

Figure 7:
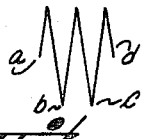
Figure 8:
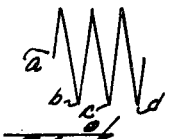

The web need not be precisely centered as illustrated, nor must the width of the web be a multiple of bases width as illustrated. The result of either of these alterations would be only to cause the free edges of the web to terminate on the leaflet on some line other than the edge of the leaflet. For example, if the web were 10 inches, the folded web would, if centered, have the configuration illustrated in FIG. 7. If the 12 inch web were off center, the resultant leaflet might take the configuration illustrated in FIG. 8.

The configuration of the folding section 25 is such that all points on the web along the bases 31 at any given instant will converge on the nip line 21 at a later instant.

Figure 4:
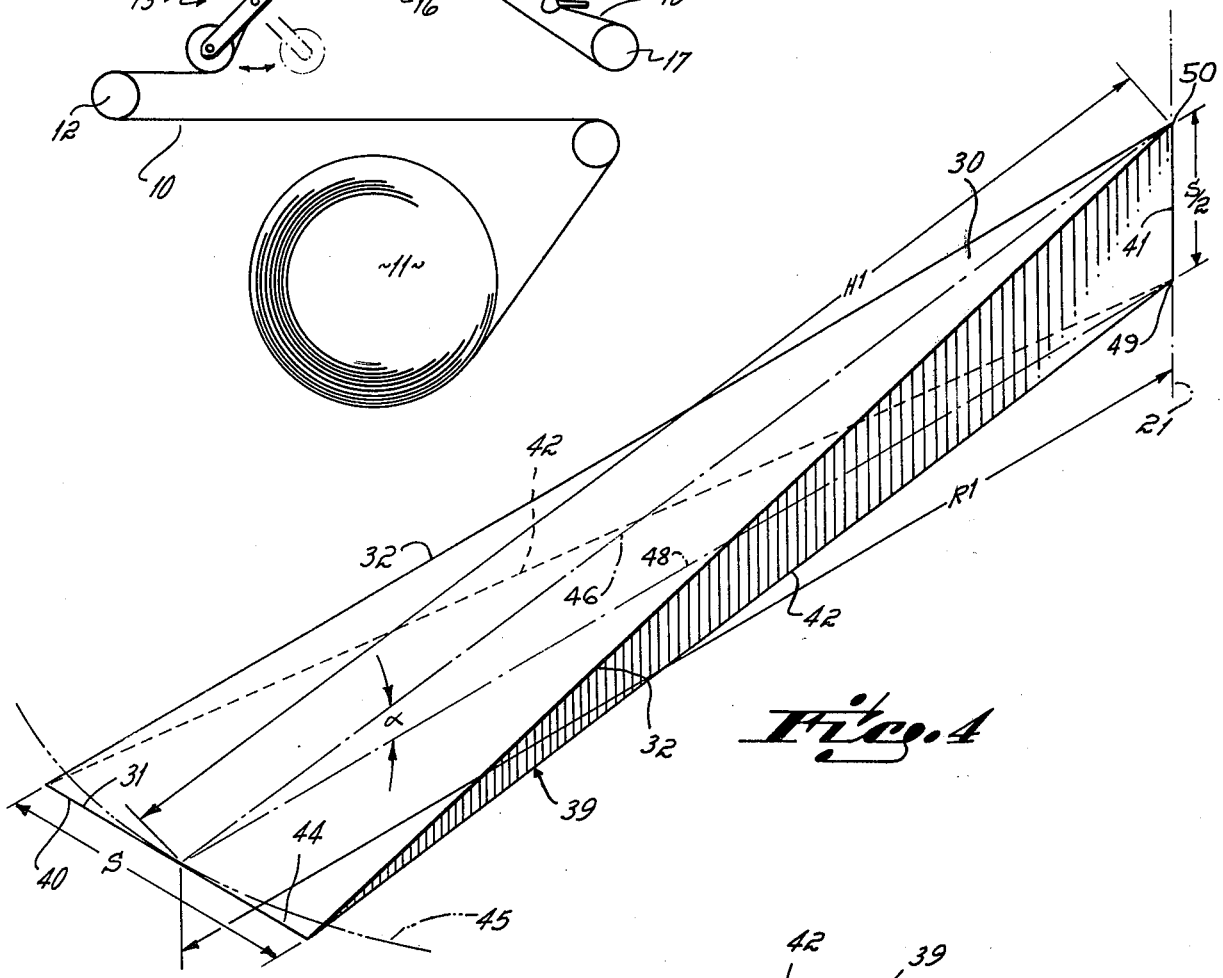
FIG. 4 is a perspective view of a section of the fan folder.
Figure 5:
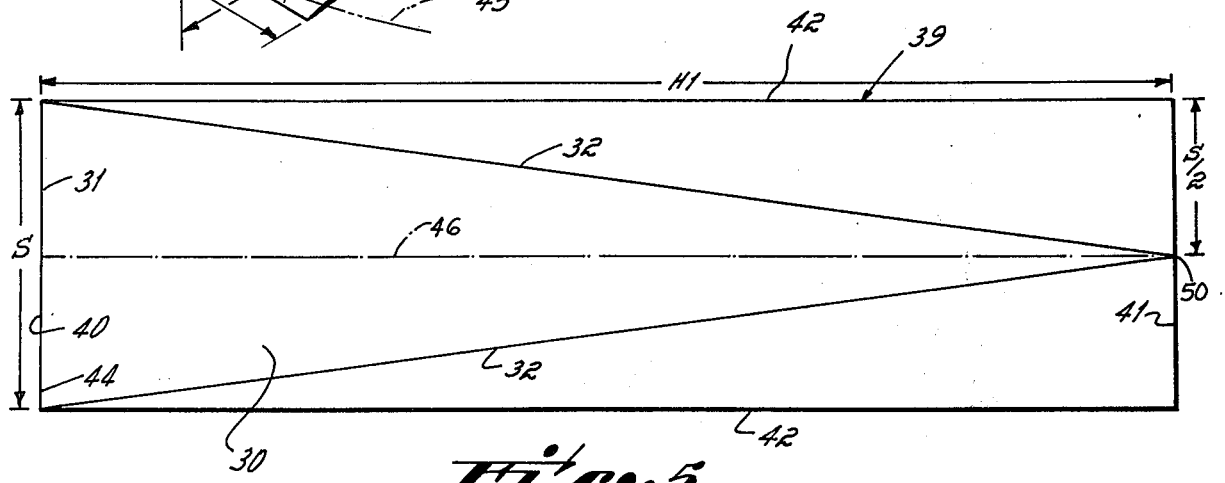
FIG. 5 is a plan view of a segment of a sheet to be folded over the section of FIG. 4.
Figure 5:
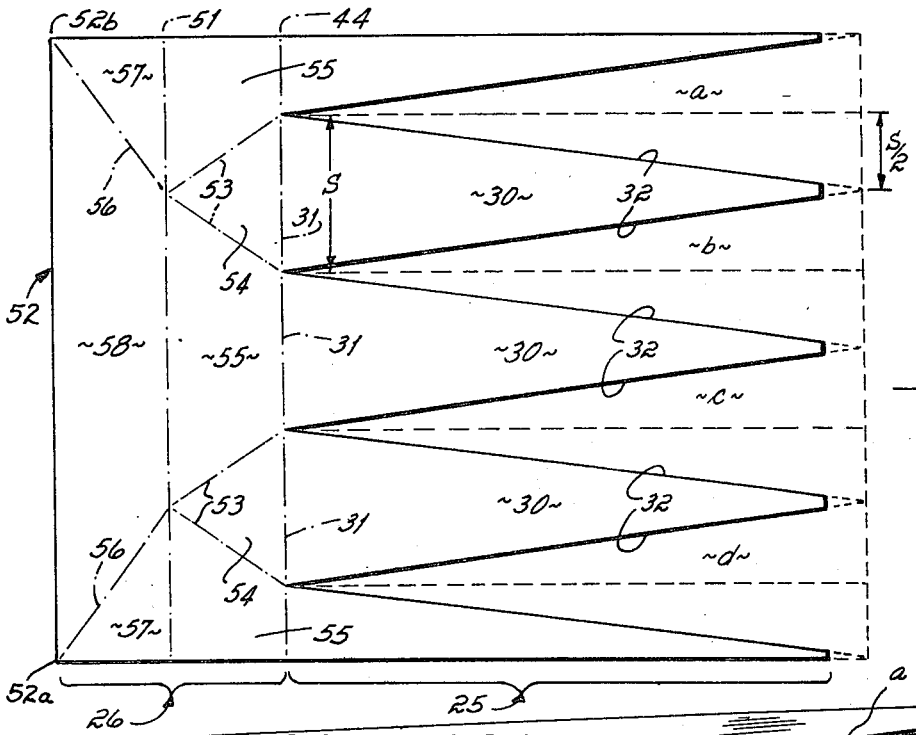

This design configuration can best be understood by reference to FIGS. 4 and 5 which are illustrative of a single triangular section 30 of the folding section 25. At any instant the section of paper 39 overlying a triangular section 30 must be formed from a rectangular segment, having one edge 40 of length equal to the length of base 31 of the triangular section 30, an opposed edge 41 of equal length at the nip and side edges 42 coinciding with the lower creases, all as illustrated in FIG. 5. If the triangular section 30 is properly shaped and angulated with respect to the nip line 21, the rectangular paper section 39 will fold around the triangular section 30 as illustrated with the forward edge 41 of the paper section lying on the nip line. Since all points along the transverse edge 40 of the paper 39 are equidistant from the parallel line 41 of the paper 39, the line 40 will move to the position of line 41 with all points along the line 40 moving at the same speed and therefore without any differential stressing.

Referring to FIG. 2, the bases 31 of the triangular sections 30 form the sides of a portion of a first polygon 44. In FIG. 4 there is shown one of the sides 31 of the polygon 44 having a length S. In order that all sections of the paper 39 (three in the illustrated embodiment) move over the folding section 25 from the bases 31 to the nip line 21 at the same speed, the interconnected bases 31 must form the sides of a portion of a first regular polygon 44 which circumscribes a circle 45 whose radius is R1 and whose center is on the nip line 21 and which lies in a plane defined by the edges 42. The angle between the triangular section 30 (defined by the base 31 and sides 32 and having an altitude 46) and the plane of the first regular polygon 44, which is the same plane as the plane of the lower triangle (defined by the base 40 and sides 42 and having an altitude 48), is determined by the desired width of the folded leaflet which in the illustrated embodiment is 2 inches. The plane of the first polygon 44 is perpendicular to the nip line 21 and the center of the circle 45 circumscribed by the first polygon 44 lies at a point 49 which is at a distance (S/2) below the point 50 of convergence of the apices of the triangular sections 30.

The calculation of the polygon is as follows:

$$R1 = \frac{S}{2} \cot \frac{180°}{n},$$

where $R1$ is the radius of the inscribed circle 45, $S$ is the length of the polygon side or base 31 and $n$ is the number of sides of the polygon.

A decision to make a 2 inch fold determines the dimension S, S being twice the fold width. R and $n$ may be varied within limits. If it is assumed that, for reasons of compactness and the like, R1 should be approximately 16 inches, a first calculation of $n$ would be as follows:

$$16 = \frac{1}{2} \times 4 \cot \frac{180°}{n}$$

$$16 = 2 \cot \frac{180°}{n}$$

$$8 = \cot \frac{180°}{n}$$

$$\frac{180°}{n} = 7.13$$

-continued $n = 25.3$ sides

In the illustrated form of the invention, it is desired that the polygon be regular and have an even number of sides. Therefore, select the number of sides to be 24 and recalculate for R1 as follows:

$$R = \frac{1}{2} \times 4 \cot \frac{180°}{n}$$

$$= 2 \cot \frac{180°}{24} = 7.5°$$

$$R = 2 \times 7.6$$

$$= 15.2 \text{ inches}$$

Therefore, R1 is approximately 15.2 inches, which is close enough to the desired 16 inches selected for design convenience. Thus, it is determined that the folder base lines 31 will be a portion of a polygon having 24 sides of 4 inches length defined by a circumscribed circle whose radius is 15.2 inches.

The angle $\alpha$ at which the plane of the triangular sections 30 lie with respect to the plane of the polygon 44 is simply calculated as follows:

$$\tan \alpha = \frac{1/2\ S}{R1}$$

In the illustrated embodiment, $\alpha = 7.5°$. The height of the triangular section H1 is also simply calculated as follows:

$$\text{sine } \alpha = \frac{1/2\ S}{H1}$$

or in the illustrated embodiment $H1 = 15.27$. This folder configuration calculated as above can be laid out on a rectangular section of the planar sheet illustrated in FIG. 3, the rectangular section being indicated at 25 corresponding to the numeral used for the folding section.

The web must be guided to the first polygon 44 defined by the bases 31 on the guiding section 26. The upstream edge 52 of the guiding section 26 must be at least as wide as the width of the paper so that the paper has a smooth transition from the feed roll 17 onto the guiding section.

The guiding section 26 is defined by a plurality of transitional polygons (or portions thereof) lying in spaced planes parallel to the plane of the first polygon. The spacing between the planes of the respective polygons is a matter of choice. Each polygon will have half the number of sides of its adjacent upstream polygon and each side will be twice the length. Thus, each downstream polygon will have the same perimeter dimension as the adjacent polygons and a web following the contour of each polygon will therefore be unstressed.

The second polygon 59 (FIG. 2) has sides 51 and circumscribes a circle having a radius R2 and whose center is on nip line 21 at the intersection of the radius line $R_2$ and the line 21. The plane of the second polygon 59 is parallel to the plane of the first polygon 44 and, in the embodiment shown in FIG. 2, lies below it. $R_2$ is calculated by the formula used above, namely, $$R2 = \frac{2\ S}{2} \cot \frac{180°}{1/2\ n}.$$

Since, in the illustrated example, S and $n$ are known, R2 is calculated as 14.92 inches in the illustrated form.

A third polygon 61 (FIG. 2) circumscribes a circle having a radius $R_3$ whose center lies on the nip line 21 at the intersection of radius line $R_3$ and line 21. The portion of the third polygon shown in FIG. 2 includes only one side 52 extending between 52*a* and 52*b*. The plane of the third polygon 61 is parallel to the planes of the first and second polygons 44 and 59 and, in the embodiment shown in FIG. 2, lies below them. $R_3$ is calculated in the same manner as $R_2$ above as 13.856 inches.

Since the length of the side of the third polygon 61 (a hexagon) is 16 inches and the web has a 12 inch width, the third polygon will provide a straight leading edge 52*a*, 52*b* of the guiding section 26. If the web had been 17 inches in length, then a fourth polygon (a triangle) would have to be calculated and employed in order to provide a straight leading edge.

The sides of the portion of the second polygon are indicated at 51 and the sides of the portion of the third polygon are indicated at 52. These sides may be laid out on the flat sheet of FIG. 3, the sides being parallel to the bases 31 and centered on the bases 31. Crease lines 53 define triangles 54 and trapezoids 55 to interconnect the sides of the first and second polygons. Crease lines 56 define triangles 57 and a trapezoid 58 to interconnect the sides of the third polygon with the sides of the second polygon.

As illustrated in FIG. 3, because all polygons have the same perimeter dimension, the polygons can be laid out on a flat metal sheet and thereafter folded along the crease lines to the configuration illustrated in FIG. 2 to form a guide from the feed roll 17 to the folding section. Guide rollers 60 may be employed to cause the paper to conform to the guide section to provide assurance that the web does track along the surface of the guide section 26.

Cooperating blades 62 projecting into the slots between triangular sections 30 may be employed to start the creasing of the web as it enters the folding section 25. The blades 62 may be of any suitable length. In the case of unstretchable paper, it is only necessary to start the creases, for the paper will hold its creases until it reaches the nip 21 between the rollers 20.

As indicated above, the folder 18 does not necessarily have to be formed from a single sheet metal member. The proper folding without differential stressing can be achieved by other guide elements as long as they define a path for the web which is comparable to that provided by the flat sheet formed as illustrated.

The foregoing description has been directed to the construction of a folder for use in making a uniform fan folded web wherein the segments of the folded web are of the same width, two inches in the illustrated form. It is possible to design folders suitable for fan folding without differential stressing wherein the folded leaflet has an irregular configuration with the segments being of varying widths as illustrated, for example, in FIG. 12 (FIG. 12 being a cross section through the folding platen which, of course, has the same configuration as the leaflet to be folded).

Figure 9:
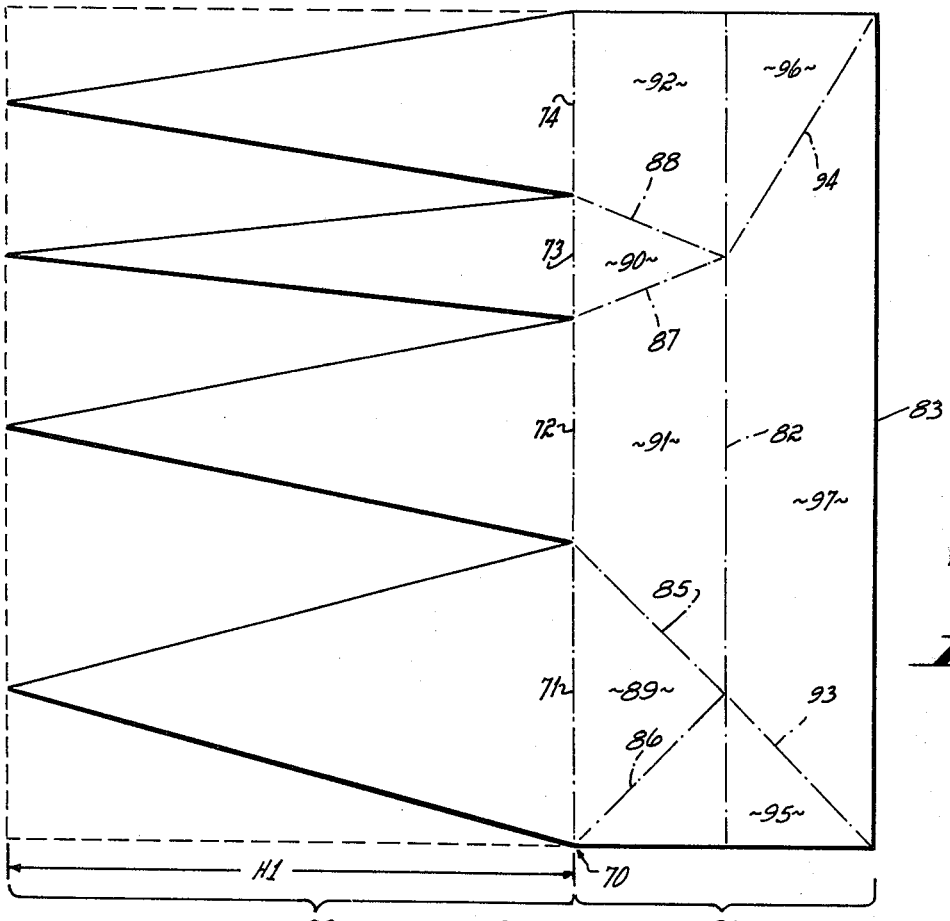
FIG. 9 is a developed view of an alternate fan folder.
Figure 10:
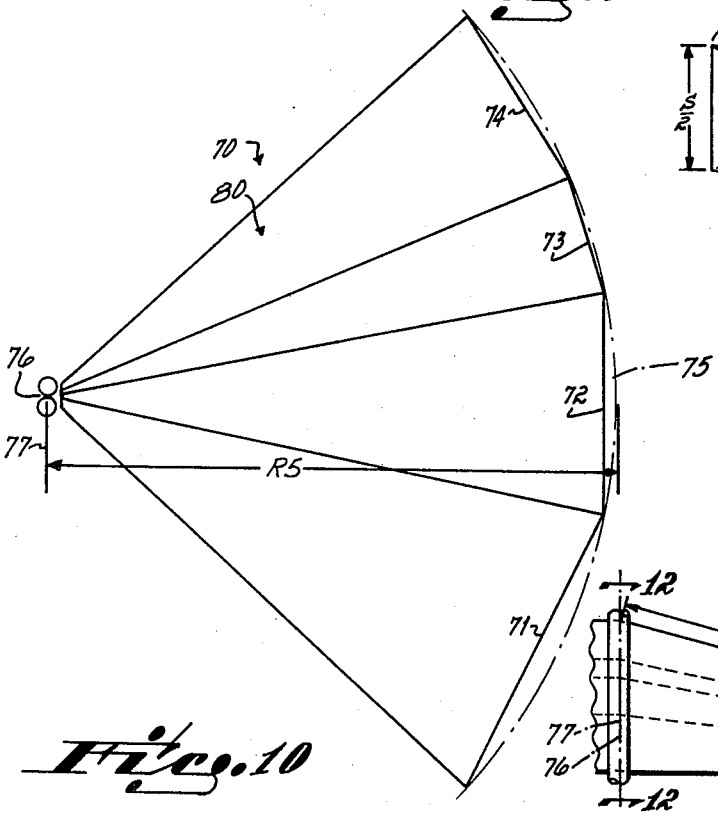
FIG. 10 is a diagrammatic top plan view of a fan folder of FIG. 9.
Figure 11:
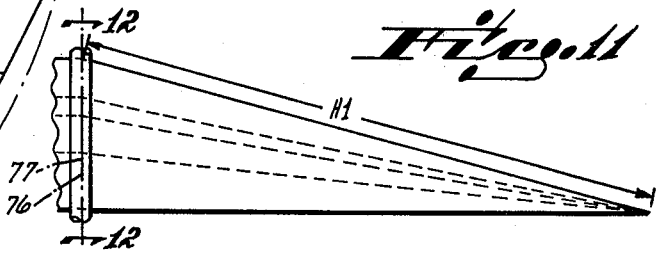
FIG. 11 is a side elevational view of the fan folder of FIG. 10.

To design such a platen, the irregular widths of the segments are laid out on a sheet of the size of the width of the leaflet when in web form, as shown in FIG. 9. There, the first "polygon" 70 has unequal sides 71, 72, 73 and 74, each corresponding to twice a leaflet segment. Those sides are laid out within the arc of a circle 75 having any desired radius R5 as shown in FIG. 10. The center 76 of that circle establishes the axis 77 of the nip through which the leaflet passes for its final folding. That point also establishes the point on the nip axis where the lower edges of the leaflet are folded.

Figure 13:
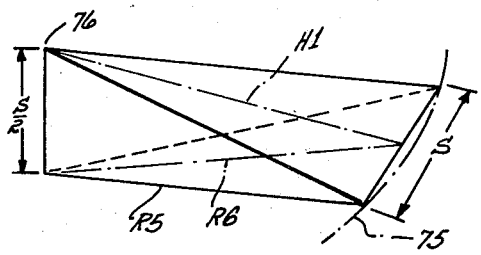
FIG. 13 is a diagrammatic perspective view of any triangular segment.

The radius R5 is the distance between the corner of any triangular segment and the point 76 where the lower folds come together in the nip. It is also the length H1 of a platen segment, as demonstrated as follows with reference to FIG. 13:

$$R5^2 = \frac{(S)\,2}{(2)} + R6^2$$

$$H1^2 = \frac{(S)\,2}{(2)} + R6^2$$

substituting for $R6^2$ $$H1^2 = \frac{(S)\,2}{(2)} + R5^2 - \frac{S\,2}{2}$$

$$H1 = R5$$

which follows since $H1$ is the length of the lower crease between a polygon corner and nip point 76. In this manner the length $H1$ of the folding section 80 is determined.

The guiding section 81 is irregular due to the irregularity of the bases 71–74 of the triangular sections. Its configuration can be determined by drawing transition lines 82 and 83 to define the sides of the second and third polygons respectively. Lines 82 and 83 are spaced from each other and from line 70 by sufficient distance to avoid very sharp bends which might make it difficult for the paper to track over the guiding section. The corners of the first polygon are connected to the second polygon by intersecting lines 85 and 86 as well as intersecting lines 87 and 88 to create triangular sections 89 and 90 as well as trapezoidal sections 91 and 92. Similarly, the corners of the polygon defined by line 82 are connected to the line 83 by lines 93 and 94 to define triangular sections 95 and 96 and a trapezoidal section 97.

Figure 12:
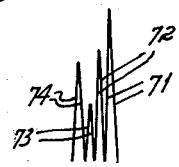
FIG. 12 is a cross-sectional view taken along lines 12—12 of FIG. 11 illustrating the fold resulting from the use of the fan folder of FIGS. 9–11.

A metallic sheet as in FIG. 9 can then be bent along the lines shown to form a folder as illustrated in FIG. 10 wherein the apices of the respective triangular sections are different heights with respect to the point 76 on the axis of the nip and thereby create the irregular fold of FIG. 12. From the embodiment of FIGS. 9–12, it can be observed that the invention admits of varying configurations, the most important and critical feature of all being that the path which the paper follows as it passes over the folder is the same path which the paper would follow if it were passed over a flat sheet from which the folder is formed.

I claim:

1. The method of fan folding a planar web moving along a path downstream to a nip while progressively and simultaneously forming upper and lower creases in said web, said method comprising the steps of, providing a nip defining a nip line, guiding said web over the sides of a portion of a first polygon, said sides circumscribing a circle lying in a first plane perpendicular to said nip line whose center is on said nip line, and upstream of said portion of said first polygon, progressively guiding said web over the sides of portions of a plurality of polygons spaced from said first polygon, the sides of said polygons circumscribing circles lying in spaced planes parallel to said first plane and to each other whose centers lie on said nip line, each upstream polygon having fewer sides than its adjacent polygon.

2. The method of claim 1 further comprising, forming the lower creases in said web from the corners of said portion of said first polygon to said nip line, said lower creases lying in said first plane, said first polygon being defined by the following relationship:

$$R = 1/2\ S \cot \frac{180°}{n},$$

where $S$ = the length of said sides of said first polygon and $2x$ the width of the fold in the nip, $n$ = the number of sides of said first polygon, and $R$ = the radius of the circumscribed circle within said first polygon.

3. Apparatus for fan folding a flexible sheet moving along a path downstream to a nip defining a nip line comprising, a folding section having a leading edge defined by the sides of a portion of a first polygon, said sides circumscribing a circle lying in a first plane perpendicular to said nip line whose center is on said nip line, and a guiding section upstream of said folding section including a plurality of edges spaced upstream from said leading edge of said folding section and one from another, said edges being defined by the sides of portions of a plurality of polygons, said sides of said polygons circumscribing circles lying in spaced planes parallel to said first plane and to each other whose centers lie on said nip line, each upstream polygon having fewer sides than its adjacent polygon.

4. Apparatus for fan folding a flexible sheet comprising, an initial planar sheet metal member configurated into a folding section and a guiding section, a folding nip defining a nip line, said folding section comprising a plurality of triangular sections, each section having a base and an apex, said bases being interconnected to form a leading edge defined by the sides of a portion of a first polygon circumscribing a circle lying in a first plane perpendicular to said nip line whose center is on said nip line, said triangular sections being spaced apart slightly to permit a fold to pass through adjacent sections, the apices of said triangular sections generally converging at a point on said nip line, said guiding section having an upstream edge to receive said sheet in planar form, and a configurated surface merging smoothly into said folding section at its leading edge, said upstream edge being defined by the sides of a portion of a second polygon circumscribing a second circle lying in a spaced plane parallel to said first plane whose center lies on said nip line, means causing said flexible sheet to follow the contour of said sheet metal member, and means for feeding said flexible sheet to said upstream edge of said guiding section.

5. Apparatus as in claim 4 in which said first polygon is defined by the following relationship:

$$R = \frac{S}{2} \cot \frac{180°}{n},$$

where $S$ = the length of a side of said first polygon, $n$ = the number of sides of said first polygon, and $R$ = the radius of the circle circumscribed by said first polygon, the center of said circle being spaced a distance (S/2) from the point of convergence of the apices of said triangular sections.

6. Apparatus as in claim 5 in which said guiding section includes a plurality of edges spaced upstream from said leading edge of said folding section and from each other, said edges being defined by the sides of a plurality of polygons, said sides of said polygons circumscribing circles lying in spaced planes parallel to said first plane and to each other whose centers lie on said nip line, each of said polygons having one-half the number of sides and twice the side length as its adjacent downstream polygon.

7. The method of making a fan folder from planar sheet metal member adapted to fold a flexible sheet moving along a path downstream to a nip defining a nip line, said method comprising the steps of:

forming a folding section having a plurality of triangular sections, each section having a base and an apex, said bases being interconnected to form a leading edge of said folding section defined by the sides of a portion of a first polygon circumscribing a circle lying in a first plane perpendicular to said nip line whose center lies on said nip line, the apices of said triangular sections converging at a point on said nip line, said first polygon being defined by the following relationship:

$$R = \frac{S}{2} \cot \frac{180°}{n},$$

where $S$ = the length of a side of said first polygon, $n$ = the number of sides of said first polygon, and $R$ = the radius of the circle circumscribed by said first polygon, the center of said circle being spaced a distance (S/2) from the point of convergence of the apices of said triangular sections, and forming a guiding section having a plurality of edges being defined by the sides of portions of a plurality of polygons, said sides of said polygons circumscribing circles lying in spaced planes parallel to said first plane and to each other whose centers lie on said nip line, said guiding section being a surface which is integral with and extending upstream from said folding section.

8. The method of making a fan folder from a planar sheet metal member adapted to fold a flexible sheet moving along a path downstream to a nip defining a nip line, said method comprising, forming a folding section having a plurality of triangular sections having bases interconnected to form a leading edge defined by the sides of a portion of a first polygon, said sides circumscribing a circle lying in a first plane perpendicular to said nip line whose center lies on said nip line, and forming a guiding section having a plurality of edges spaced upstream from said leading edge of said folding section and one from another, said edges being defined by the sides of portions of a plurality of polygons, said sides of said polygons circumscribing circles lying in spaced planes parallel to said first plane and to each other whose centers lie on said nip line, each upstream polygon having fewer sides than its adjacent polygon, said guiding section being integral with and extending upstream from said folding section, said sides of said polygons being interconnected by planar sheet metal sections.

9. The method of fan folding a planar web moving along a path downstream to a nip while progressively and simultaneously forming upper and lower creases in said web, said method comprising the steps of, providing a nip defining a nip line, providing a folding section having a leading edge defined by the sides of a portion of a first polygon, said sides circumscribing a circle lying in a first plane perpendicular to said nip line whose center is on said nip line, providing a guiding section upstream of said folding section including a plurality of edges spaced upstream from said leading edge of said folding section and one from another, said edges being defined by the sides of portions of a plurality of polygons, said sides of said polygons circumscribing circles lying in spaced planes parallel to said first plane and to each other whose centers lie on said nip line, feeding said web to the upstream edge of said guiding section, and guiding said web progressively over said guiding section to said leading edge of said folding section, over said folding section, and through said nip, each point along a transverse line across said web traveling the same distance as the web is converted from a planar condition to an accordian fold at said nip.

* * * * *